US005419134A

United States Patent [19]

Gibson

[11] Patent Number: 5,419,134

[45] Date of Patent: May 30, 1995

[54] DISPLAY HOLDER

[75] Inventor: Scott S. Gibson, Mercer Island, Wash.

[73] Assignee: Burke Gibson, Inc., Auburn, Wash.

[21] Appl. No.: 23,694

[22] Filed: Feb. 26, 1993

[51] Int. Cl.[6] ..... G09F 15/00

[52] U.S. Cl. ..... 40/606; 40/611; 40/617; 40/649; 248/223.4; 248/231.4; 248/548

[58] Field of Search ..... 40/606, 608, 611, 617, 40/642, 649; 248/214, 223.4, 225.1, 231.4, 548

[56] References Cited

U.S. PATENT DOCUMENTS

| | | | |
|---|---|---|---|
| Re. 30,734 | 9/1981 | Eckert . | |
| 1,559,010 | 10/1925 | Schwieger . | |
| 1,793,563 | 2/1931 | Schwartz . | |
| 1,866,723 | 7/1932 | Powers . | |
| 2,646,241 | 7/1953 | McLean . | |
| 2,787,433 | 4/1957 | Slavsky et al. . | |
| 3,102,351 | 9/1963 | Howell | 40/611 |
| 3,529,798 | 9/1970 | Williams et al. . | |
| 3,969,838 | 7/1976 | Moore | 40/611 |
| 4,344,244 | 8/1982 | Tyke . | |
| 4,531,311 | 7/1985 | Howard et al. | 40/649 |
| 4,574,507 | 3/1986 | Elliott . | |
| 4,593,486 | 6/1986 | Visocky et al. . | |
| 4,616,799 | 10/1986 | Rebentisch . | |
| 4,709,891 | 12/1987 | Barnett | 248/214 |
| 4,729,183 | 3/1988 | Tarter et al. | 40/642 |
| 4,791,739 | 12/1988 | Hetzer . | |
| 4,805,331 | 2/1989 | Boggess et al. . | |
| 4,821,437 | 4/1989 | Abramson et al. | 40/642 |
| 4,866,867 | 9/1989 | Clark . | |
| 4,881,707 | 11/1989 | Garfinkle . | |
| 4,884,351 | 12/1989 | Abramson | 40/611 |
| 4,909,464 | 3/1990 | Levine et al. . | |
| 4,957,256 | 9/1990 | Boeding . | |
| 5,111,606 | 5/1992 | Reynolds . | |
| 5,189,822 | 3/1993 | Schmanski et al. | 40/642 |

*Primary Examiner*—Edward K. Look
*Assistant Examiner*—James A. Larson
*Attorney, Agent, or Firm*—Delbert J. Barnard; Glenn D. Bellamy

[57] ABSTRACT

A display holder (10) is formed from a main frame member that is a single extrusion. The main frame member includes opposite edge frame portions (28, 30) and a center panel (10). Frame portions (64, 66) snap onto the ends of a center panel (10) to complete a frame that extends entirely about the periphery of the display holder (10). The display holder (10) may be mounted by a mounting member (44) which includes a hinge strip (92). Hinge strip (92) and a pair of mounting member flanges (42, 90) may be made by a co-extrusion process. A rigid structural plastic is used to form the flanges (42, 90). A bendable, resilient plastic is used to form the hinge strip (96). The hinge strip (96) will bend in response to a side force applied to the display holder (10). Hinge strip (92) will act as a spring and will swing the display holder (10) back to its at rest position when the force is removed. A mounting member (118) may be used which includes a longitudinally split, tubular rib (130), with trunnions (136, 138) inserted into the end portions of the rib (130). These trunnions (136,138) may extend through aligned openings (152, 156) and mount the display holder (10) for pivotal movement about a vertical axis. A plurality of display holders (10) may be mounted close together by use of the trunnions (136, 138) and the openings (152, 156).

14 Claims, 5 Drawing Sheets

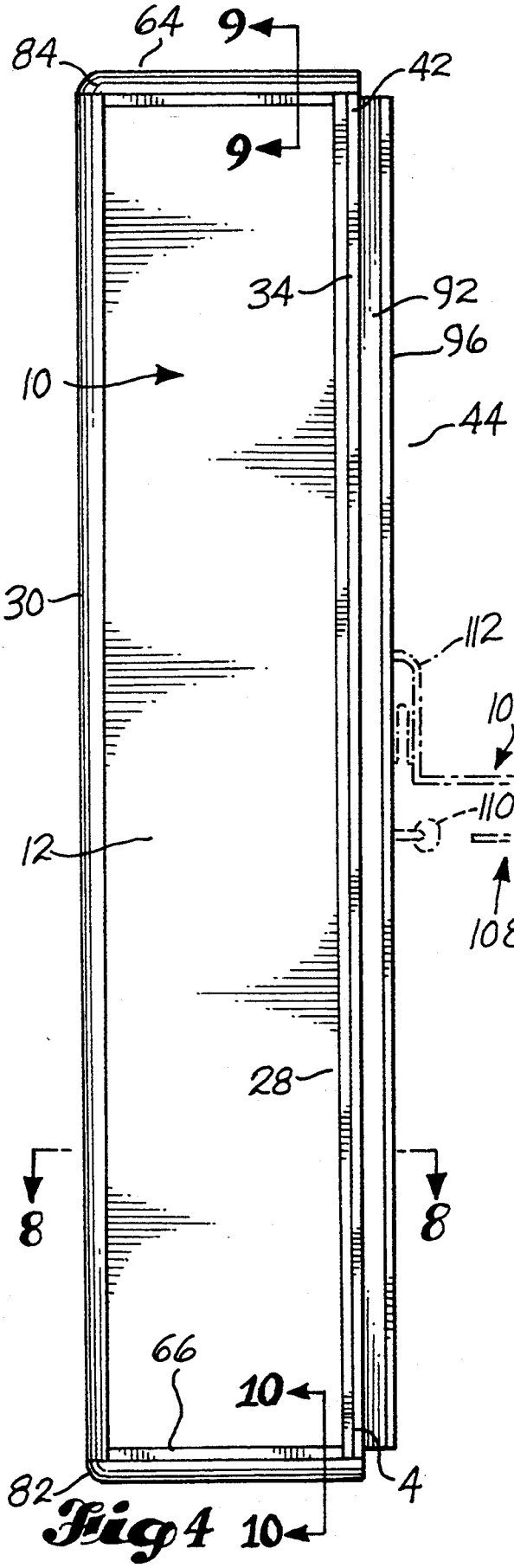
Fig. 4
Fig. 5
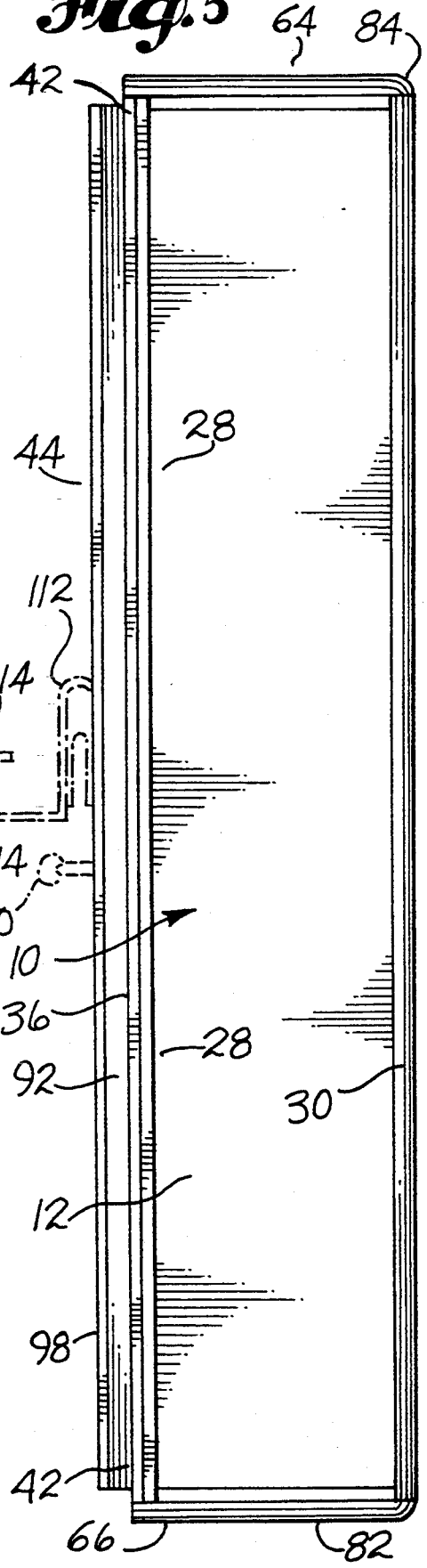

Fig. 6
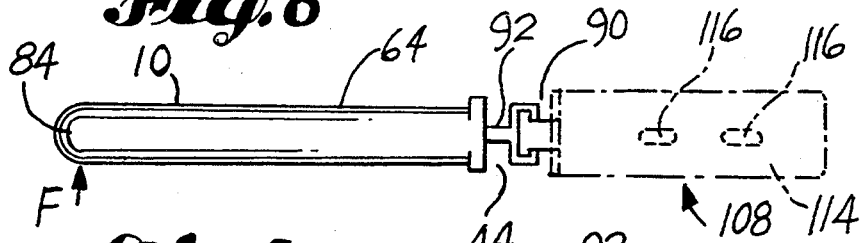
Fig. 7
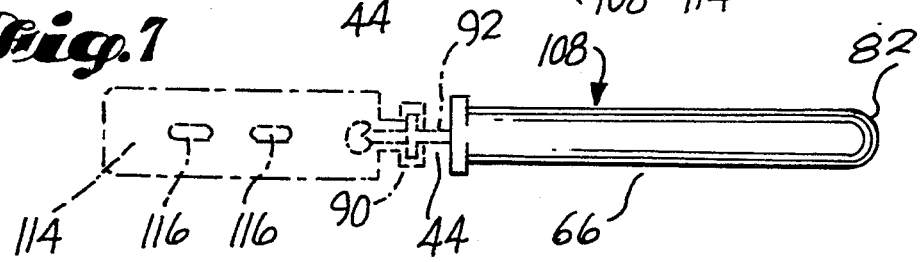
Fig. 8
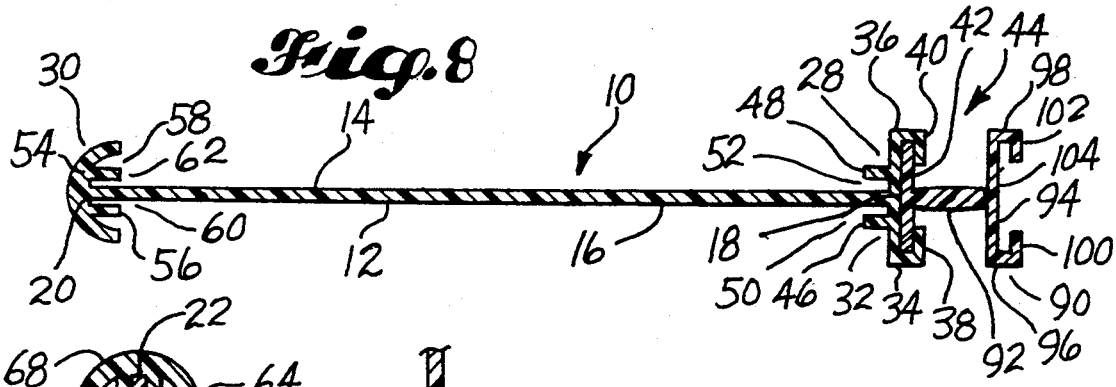
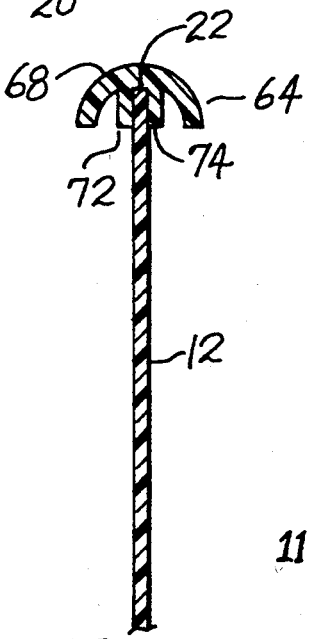
Fig. 9
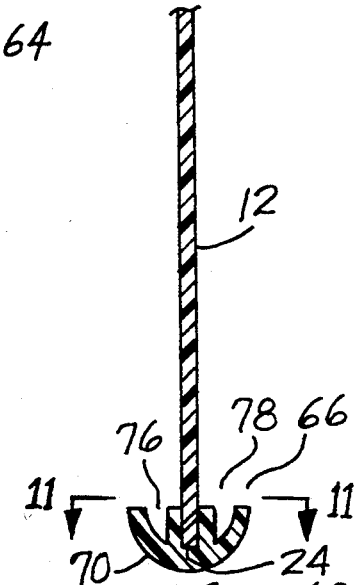
Fig. 10
Fig. 12
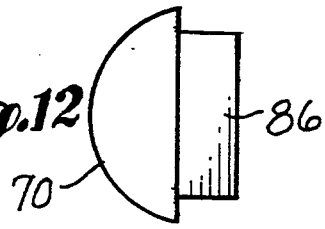
Fig. 13
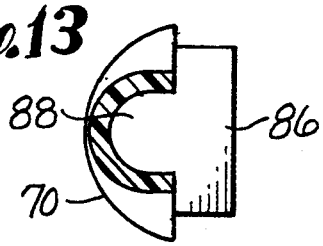
Fig. 11
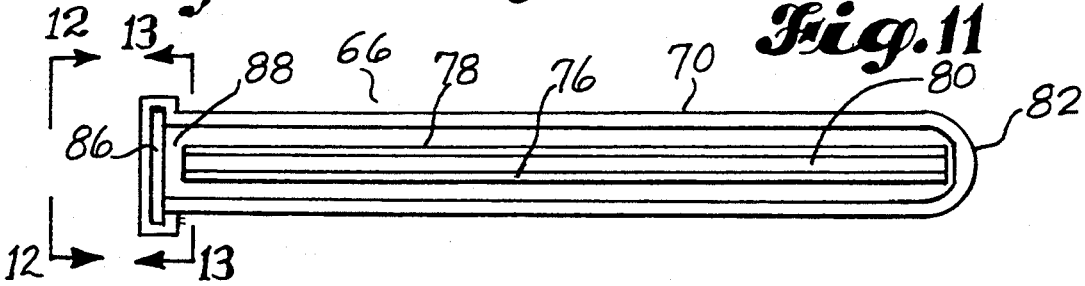

DISPLAY HOLDER

TECHNICAL FIELD

This invention relates to display holders for sign boards, paint samples, etc. More particularly, it relates to the provision of improved display boards which are adapted to be mounted in a vertical orientation, by a structure which permits a swinging movement of the sign board about a generally vertical axis.

BACKGROUND INFORMATION

The following United States patents show various types of sign boards which are adapted to be mounted in a vertical orientation: U.S. Pat. No. 1,559,010, granted Oct. 27, 1925, to George B. Schwieger; U.S. Pat. No. 1,793,563, granted Feb. 24, 1931, to Eugene Schwartz; U.S. Pat. No. 1,866,723, granted Jul. 12, 1932, to Howard C. Powers; U.S. Pat. No. 2,646,241, granted Jul. 21, 1953, to Robert E. McLean; U.S. Pat. No. 2,787,433, granted Apr. 2, 1957, to Robert J. Slavsky and John R. Slavsky; U.S. Pat. No. 3,529,798, granted Sep. 22, 1970, to Donald C. Williams and Richard G. Growei U.S. Pat. No. 4,574,507, granted Mar. 11, 1986, to Paul G. Elliott; U.S. Pat. No. 4,616,799, granted Oct. 14, 1986, to Hugo E. Rebentisch; U.S. Pat. No. 4,805,331, granted Feb. 21, 1989, to Charles H. Boggess and Richard G. Krautsack; U.S. Pat. No. 4,866,867, granted Sep. 19, 1989, to Kenneth H. Clark; U.S. Pat. No. 4,881,707, granted Nov. 21, 1989, to Benjamin L. Garfinkle; U.S. Pat. No. 4,909,464, granted Mar. 20, 1990, to Stanley L. Levine and Lee R. Wiese; U.S. Pat. No. 4,957,256, granted Sep. 18, 1990, to Mary B. Boeding; and U.S. Pat. No. 5,111,606, granted May 12, 1992, to Randy B. Reynolds.

U.S. Pat. No. 4,805,331 discloses a display holder that is adapted to be mounted onto the front of a store shelf by a structure which holds the display holder in a vertical orientation and in a position that is generally perpendicular to the front edge of a shelf, but which allows the display holder to pivotally move out of the way of a customer or article that strikes it. The display holder includes a bias means which automatically returns it to its normal position when the force causing it to swing has been removed. This ensures that the advertising message or display continuously remains in a direct view of approaching customers. An object of the present invention is to provide a display holder capable of performing the function of the display holder disclosed in U.S. Pat. No. 4,805,331, but which is much simpler in construction.

U.S. Pat. No. 4,881,707 discloses a display holder similar to the display holder disclosed by U.S. Pat. No. 4,805,331, except it includes a hinge comprised of a plurality of stria which are formed from a flexible material such as thermoplastic elastomer. An object of the present invention is to provide an improved construction of the display holder and a flexible strip hinge which is selectively usable with the display holder for better serving the objectives of the display holder and hinge disclosed by U.S. Pat. No. 4,881,707.

Another object of the present invention is to provide a mounting structure for the display holder which both structurally reinforces a frame member of the display holder and provides a support for upper and lower trunnions which are used to mount the display holder for pivotal movement about a vertical axis.

DISCLOSURE OF THE INVENTION

According to an aspect of the invention, a display holder is provided which is basically characterized by a center panel having two side faces, two side edges, a top edge and a bottom edge. A first frame portion is at the first side edge. A second frame portion is at the second side edge. A third frame portion is at the top edge. A fourth frame portion is at the bottom edge. An opposite edge pair of frame portions form with the center panel a pair of confronting channels which receive mounting portions of a display. At least one of the remaining two frame portions is removable to permit insertion of a display into or removal of a display out from the channels.

In accordance with an important aspect of the invention, the opposite edge frame portions are formed integral with the center panel. Preferably, these frame portions and the center panel are a single extrusion.

In accordance with an aspect of the invention, the remaining two frame members are detachable from the center panel and include channels for snugly receiving end portions of the center panel. These frame portions may be injection molded.

In preferred form, the first edge frame portion is formed integral with the center panel and comprises a base strip which extends perpendicular to the center panel. The base strip has opposite side edges. A first flange is connected to the first side edge of the base strip. A second flange is connected to the second side edge of the base strip. The flanges extend from the base strip in a direction generally opposite the center panel. A first lip extends laterally inwardly from the first flange. A second lip extends laterally inwardly from the second flange. The lips are spaced from the base strip. The base strip, the flanges and the lips together form a channel space for receiving a flange portion of a mounting member.

In accordance with one aspect of the invention, a mounting member is provided which is in the nature of an elongated extrusion. This mounting member comprises a first flange sized to be received within the channel space of the first edge frame portion, a second flange spaced from the first flange, and an interconnecting web. The first and second flanges are formed of a relatively rigid structural plastic. The web is formed from a resilient structural plastic and functions as a hinge. The second flange of the mounting member is connected to a shelf or frame member. The display holder extends generally perpendicular to the front edge of a shelf or frame member. The hinge strip allows the display holder to pivotally move out of the way of a customer or article that strikes it. The hinge strip automatically returns the display holder to its normal at rest position when the force causing it to swing has been removed.

According to another aspect of the invention, a mounting member is used which comprises a flange that is slidable into the channel space of the first edge frame portion and a longitudinally split tubular rib. Each end of this tubular rib receives a trunnion having an outer end part which projects beyond its end of the display holder. The trunnions fit into aligned openings in spaced apart members which are secured to a shelf end wall, a frame member, or the like. This type of mounting may be used to mount a plurality of display holders relatively close together, each for pivotal movement about a separate vertical axis.

In preferred form, the first frame portion includes a pair of frame flanges, on opposite sides of the panel. The frame flanges extend from the base strip in the same direction as the center panel. Each frame flange is spaced from the center panel so as to with the center panel form a vertically extending channel.

BRIEF DESCRIPTION OF THE DRAWINGS

Like reference numerals and letters are used to designate like parts throughout the several views of the drawing, and:

FIG. 4 is a first side elevational view of the display holder shown by FIGS. 1–3;

FIG. 5 is a second side elevational view of the display holder shown by FIGS. 1–4;

FIG. 6 is a top plan view of the display holder shown by FIGS. 1–5;

FIG. 7 is a bottom plan view of the display holder shown by FIGS. 1–6;

FIG. 8 is a transverse sectional view taken substantially along line 8—8 of FIG. 4;

FIG. 9 is a vertical sectional view taken substantially along line 9—9 of FIG. 4;

FIG. 10 is a vertical sectional view taken substantially along line 10—10 of FIG. 4;

FIG. 11 is a top plan view of the bottom end cap taken substantially from the position of line 11—11 of FIG. 10;

FIG. 12 is an end view of the end cap shown by FIG. 11, such view being taken generally from an aspect indicated by line 12—12 in FIG. 11;

FIG. 13 is a sectional view taken substantially along line 13—13 of FIG. 11;

BEST MODE FOR CARRYING OUT THE INVENTION

Figures 1, 2, 3:
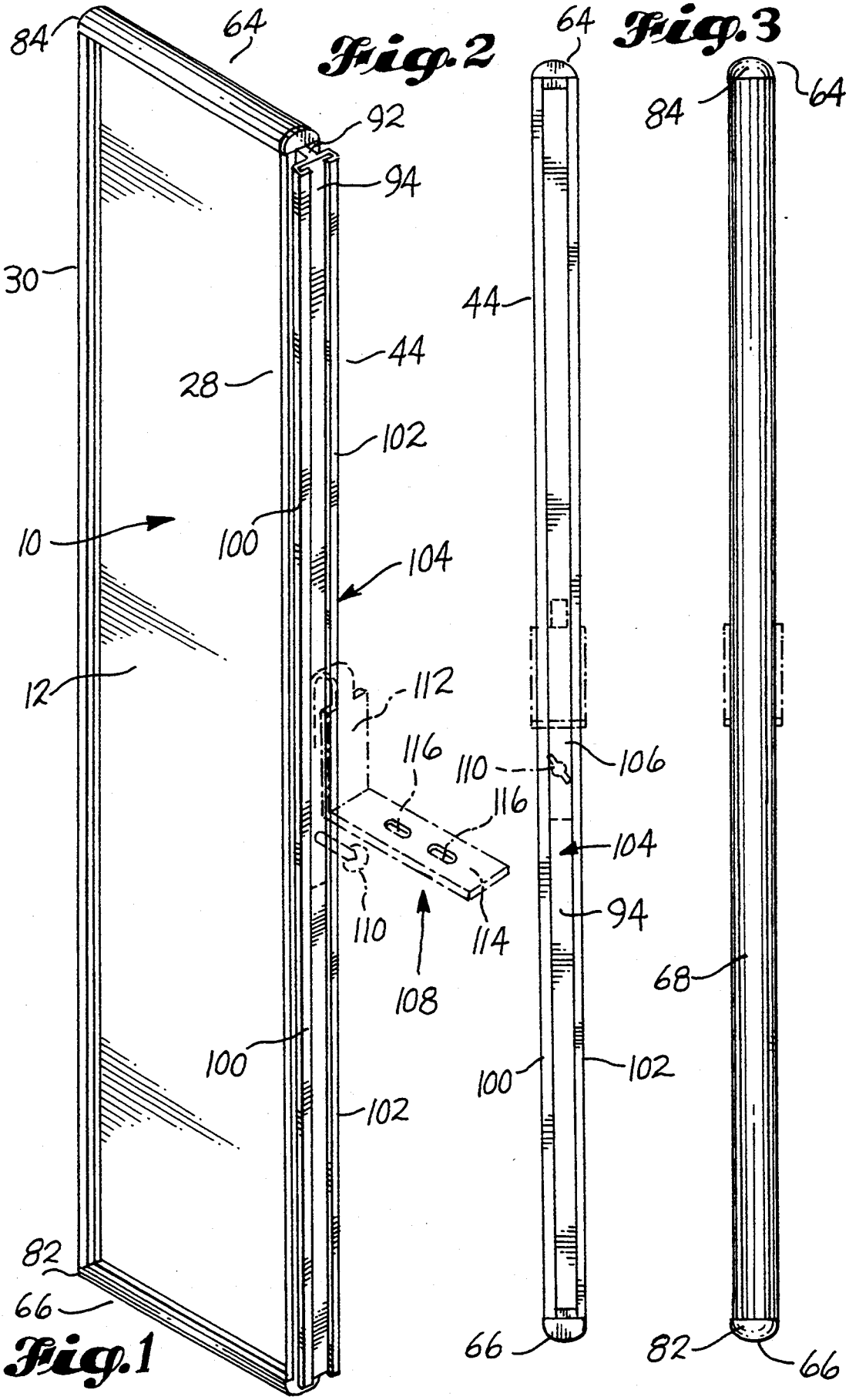
FIG. 1 is a pictorial view of a display holder incorporating the invention, shown in its upright position, and taken from above and towards the top, one side and the rear edge.
FIG. 2 is a rear edge elevational view of the display holder shown by FIG. 1.
FIG. 3 is a front edge elevational view of the display holder shown by FIGS. 1 and 2.

Referring to FIGS. 1–6, in preferred form, the display holder of the present invention comprises a main member 10 that is preferably an extrusion. The cross-sectional shape of this extrusion is shown by FIG. 8. Main member 10 includes a center panel 12 having a first side face 14 and a second side face 16. Center panel 12 also includes a first side edge 18, a second side edge 20, a third edge 22 at its top (FIG. 9) and a fourth edge 24 at its bottom (FIG. 10). Edges 18, 20 are sometimes referred to as first and second opposite edges. This is because they are at opposite side edge boundaries of the center panel 12. Edges 22 and 24 are sometimes referred to as third and fourth opposite edges. This is because they are at opposite end boundaries of the center panel 12.

Referring back to FIG. 8, the extrusion which includes center panel 12 also includes first and second frame portions 28, 30. Frame portion 28 includes a base strip 32 which extends perpendicular to center panel 12. In preferred form, base strip 32 projects outwardly, an equal amount on each side of the center panel 12. A first flange 34 is connected to a first edge of base strip 32. A second flange 36 is connected to the second edge of base strip 32. The flanges 34, 36 are parallel to each other and both extend from the base strip 32 in a direction opposite from center panel 12. A first lip 38 is connected to flange 34. A second lip 40 is connected to flange 36. Lips 38, 40 are coplanar with each other and are in laterally spaced parallelism with base strip 32. Base strip 32, flanges 34, 36 and lips 38, 40 together form a lipped channel in which one flange 42 of a mounting member 44 is received. The lipped channel opens edgewise outwardly of the center panel 12. Frame portion 28 includes a pair of frame flanges 46, 48 which project from base strip 32, in a laterally spaced relationship with the center panel 12. Frame flanges 46, 48 extend parallel to each other and to the center panel 12. A channel 50 is formed by and between center panel 12 and frame flange 46. A channel 52 is formed by and between center panel 12 and frame flange 48.

Frame portion 30 comprises a cap strip 54 and a pair of frame flanges 56, 58. Cap strip 54 is generally semi-annular in cross-sectional shape. Frame flange 56 extends from cap strip 54 in a laterally spaced relationship with center panel 12. Frame flange 58 also extends from cap strip 54 in a laterally spaced relationship from center panel 12, but on the opposite side of the center panel 12 from frame flange 56. Frame flanges 56, 58 extend parallel to each other and to the center panel 12. A channel 60 is formed by and between center panel and frame flange 56. On the opposite side of the center panel 12, a channel 62 is formed by and between center panel 12 and frame flange 58.

As shown by FIG. 8, channel 60 confronts channel 50 on a first side of center panel 12. Channel 62 confronts channel 52 on the opposite side of center panel 12. The channels 50, 60 and 52, 62 receive side edge portions of a article or articles to be displayed. For example, a plastic or cardboard sign board may be slid endwise of the display holder, with its opposite edge portions within channels 50, 60. A duplicate of this display board can be located in channels 52, 62 on the opposite side of display holder 10. Or, for example, a plurality of strips of wood, each bearing a different paint sample, can be slid into the channels 50, 60 and/or 52, 62.

Frame portions 64, 66 may be injection molded from a suitable structural plastic. As shown by FIGS. 9 and 10, frame portions 64, 66 comprise cap strips 68, 70 which are like cap strip 54, in cross-sectional configuration. However, they include flanges 72, 74 and 76, 78 which are parallel to each other and laterally spaced apart a distance substantially equal to the thickness of center panel 12. As shown by FIG. 9, the upper edge portion of center panel 12 is snugly fitted in a channel formed by and between flanges 72, 74. As shown by FIG. 10, a lower end portion of center panel 12 is snugly fitted within a channel formed by and between flanges 76, 78. FIG. 11 is a top plan view of frame portion 66. It is also a bottom plan view of frame portion 64 because frame portions 64, 66 are identical in construction. In FIG. 11, the channel in which the lower end portion of center panel 12 is received is designated 80.

As shown by FIG. 11, the end of frame portion 66 which meets the end of frame member 30, at a lower corner of the display holder, is rounded at 82. This rounded corner region is substantially in the shape of a quarter sphere. Frame portion 64 includes a like end region 84. Referring to FIG. 11, the opposite end of frame portion 66 includes a tongue 86 which extends downwardly into the lipped channel formed by base strip 32, flanges 34, 36 and lips 38, 40. It also includes a space 88 in which is received a central end portion of base strip 32, when frame portion 66 is connected to the lower edge portion of center panel 12. Mounting member 44 is shorter in length than base strip 32. The opposite ends of mounting member 44 are spaced endwise inwardly of frame portions 64, 66, to allow entry of the end portions of mounting strip 32 into the space 88 in frame portion 66, and into a like space in frame member 64. The end portions of center panel 12 are snugly received between the flanges 72, 74 at the top and 76, 78 at the bottom. In this manner, the frame portions 64, 66 are frictionally connected to the ends of the main member 10. As can be seen from the several drawing figures, when the frame portions 64, 66 are in place, they form end closures for the channels 50, 60 and 52, 62.

Mounting member 44 includes flange 42, a base flange 90 and a web 92. Base flange 90 includes a base wall 94 that is in spaced parallelism with flange 42. Wall 94 extends perpendicular to web 92. Flanges 96, 98 extend from wall 94 in a direction opposite web 92. Flanges 96, 98 are parallel to each other and are perpendicular to wall 94. Lips 100, 102 extend inwardly from flanges 96, 98. Lips 100, 102 are in coplanar parallelism. They are also in spaced parallelism with wall 94. Wall 94, flanges 96, 98 and lips 100, 108 together form a lipped channel 104 which extends the full length of the mounting member 44.

Figure 14:
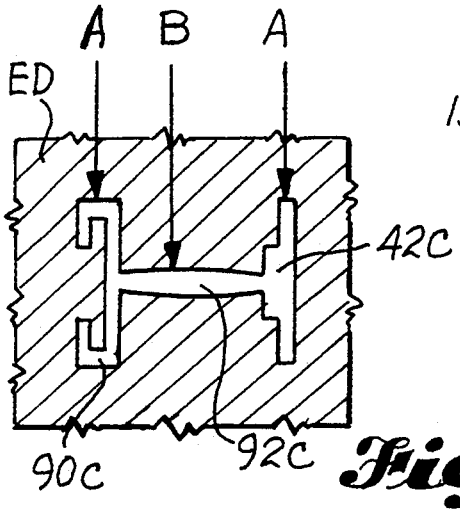
FIG. 14 is a sectional view through an extrusion die used for forming the mounting member by a co-extrusion process.

In accordance with an aspect of the invention, mounting member 44 is manufactured by a co-extrusion process. Referring to FIG. 14, die cavities **42*c*, 90*c*, 92*c* are formed in an extrusion die ED. A first structural plastic "A" is introduced into cavities 42*c* and 90*c* while a second plastic "B" is introduced into cavity 92*c*. The two plastics "A" and "B" bond together as they move through the die ED. Plastic "A" is a relatively strong and rigid structural plastic, e.g. rigid PVC. Plastic "B" is a strong but resilient plastic, e.g. resilient PVC. It is bendable but returns to its at rest shape when the bending force is removed from it. Referring to FIG. 6, for example, when a force "F" is applied against the display holder 10, it will cause the web 92, which also may be referred to as a "hinge strip", to bend. When force F is removed, the hinge strip 92 returns to its at rest position, shown in FIG. 8. Thus, hinge strip 92 is in the nature of a spring. It is bendable but as it bends it stores spring energy. When the bending force is removed, the spring energy moves the hinge strip 92 back into its at rest position. Preferably, the at rest position has the display holder 10 extending generally perpendicular to the member to which mounting flange 90** is connected.

As shown in FIGS. 1, 2 and 4–7, an elongated tongue portion 106 of a connector 108 may fit snugly within lipped channel 104. A set screw 110 may be threaded into a threaded opening in the tongue 106. Set screw 110 can be rotated clockwise to exert a locking force against wall 94 of lip channel 104. In this manner the set screw 110 holds the connector 108 firmly to the mounting member 44. Connector 108 extends upwardly and rearwardly from tongue 106 and then downwardly as a rear leg 112. It then extends horizontally as a mounting leg 114. The mounting leg 114 may be set down on a shelf and screw fasteners (not shown) may be inserted through openings 116 and used to firmly connect the connector 108 to the shelf. Of course, other methods of attaching the display holder 10 to a shelf or other support member may be employed.

Figure 16:
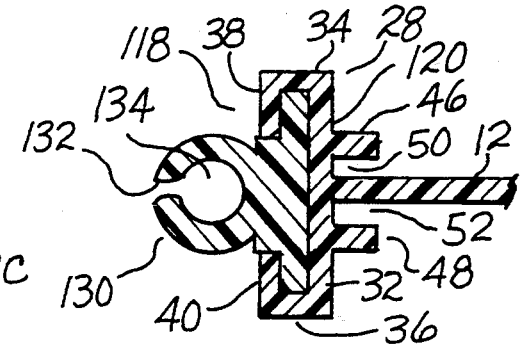
FIG. 16 is a transverse sectional view taken through the rear flange of the display holder and a mounting member adapted to mount the display holder in the manner shown by FIG. 15.
Figure 15:
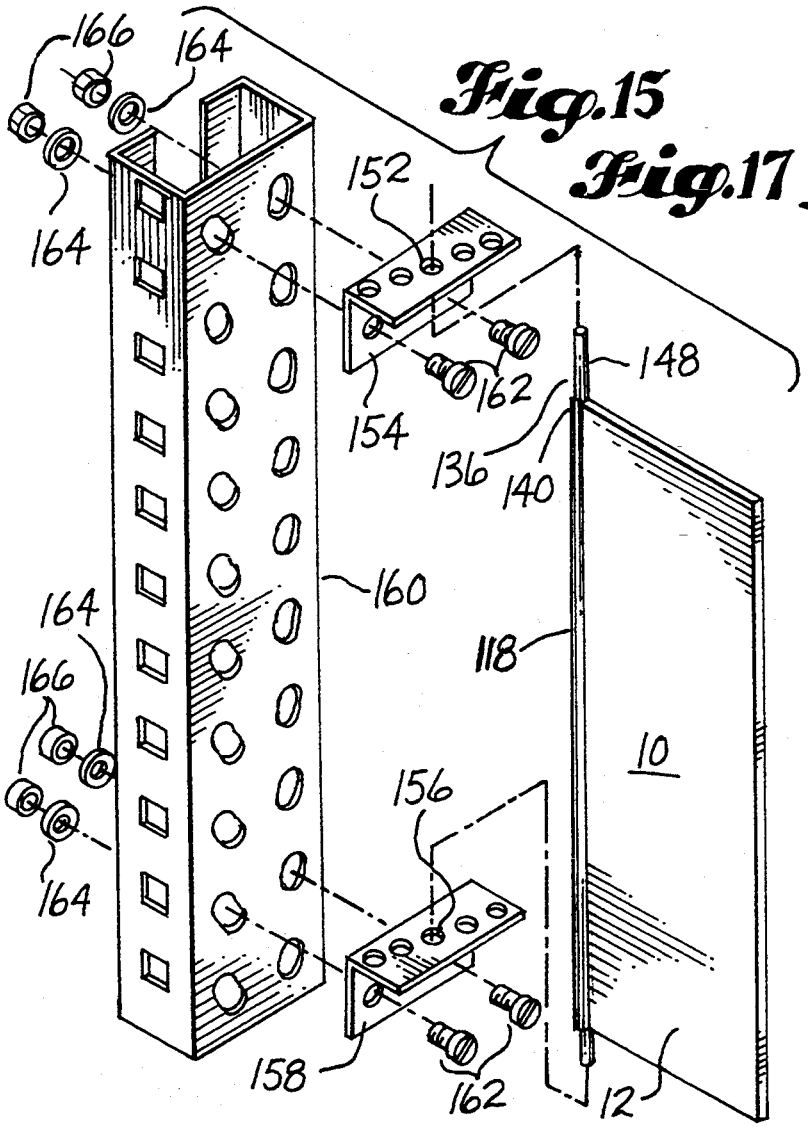
FIG. 15 is an exploded pictorial view of the display holder of FIGS. 1–7, shown with a modified mounting structure.
Figure 17:
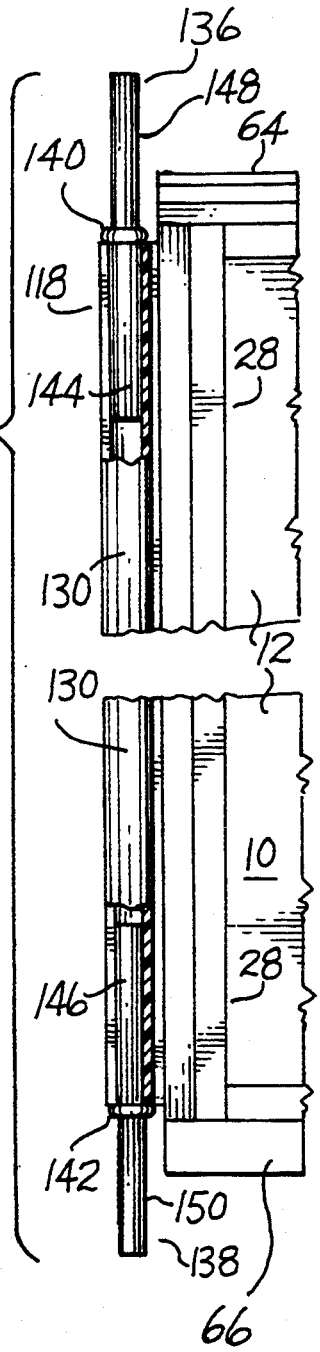
FIG. 17 is a fragmentary elevational view showing the upper and lower ends of the display holder and the mounting structure shown by FIG. 15.

FIGS. 15–17 relate to a modified embodiment of the invention in which the mounting member 44 is replaced by a different style of mounting member 118. Mounting member 118 has a uniformed cross section throughout its length (FIG. 16). It is equal in length to mounting member 44. Mounting member 118 includes a flange 120 that is like flange 42. Flange 120 fits snugly within the lipped channel in frame portion 28 formed by the base strip 32, the flanges 34, 36 and the lips 38, 40 (FIG. 16). Mounting member 118 also includes a slotted, tubular rib 130. Rib 130 is substantially annular in cross section but includes a slot 132 which extends the full length of rib 130. It also includes a center opening 134. Rib 130 provides a strong back bone for the mounting member 118. It also provides mounting sockets for a pair of trunnions 136, 138. Each trunnion 136, 138 includes an enlargement 140, 142 which divides it between inner and outer parts. Each inner part 144, 146 fits snugly within the opening 134 at one end of the rib 130. The enlargements 140, 142 fit against the end surface of the rib 130 and prevent movement of the trunnion 136, 138 into the opening 134 beyond the location of enlargement 140, 142. The outer or outboard portions 148, 150 of the trunnions 136, 138 each extend coaxial with the other. The outboard end portion 148 of trunnion 136 extends through an opening 152 in an upper mounting bracket 154. Specifically, opening 152 is in a horizontal leg of the bracket 154. The outboard end portion 150 of trunnion 138 fits within an opening 156 in a second bracket 158. As shown by FIG. 15, opening 156 is in a horizontal leg of bracket 158. Brackets 154, 156 are secured to a frame member 160, by fastener assemblies including bolts 162, washers 164 and nuts 166, as shown in FIG. 15.

The opening 134 is slightly smaller in diameter than the diameter of end parts 144, 146 of the trunnions 136, 138. Thus, it is necessary to force the end parts 144, 146 into the ends of the opening 134. This is permitted by the slot 132. It allows the side portions of the rib 130, on opposite sides of slot 132, to spread apart slightly as the trunnions are forced inwardly. This makes the side portions act as springs or clamps. They firmly grip and hold the end portions 144, 146 of the trunnions 136, 138. The lower enlargement 142 also acts as an end bearing, where it bears against the metal surrounding opening 134.

As shown in FIG. 15, the horizontal legs of the brackets 154, 158 may be provided with a plurality of laterally spaced apart openings. In the illustrated example, five openings are shown. This permits the mounting of five display holders 10, as a group, between the two brackets 154, 158. Other ways of mounting the display holder may be used. Also, the configuration of the display holder may vary from what is illustrated.

The corners 82, 84 are rounded and the frame portions 30, 64, 66 are rounded in the lateral direction. This provides a surface which is not apt to cause any injury if struck by a person or any damage to an object that may be accidently moved in contact with the display holder 10. The illustrated display holders are vertically elongated. However, certain aspects of the invention could be used with advantage within a display holder that is horizontally elongated. For example, the construction of the display holder from a single extrusion main member, including a center panel and opposite edge frame portions, together with detachable frame members for the other pair of opposite edges.

Figure 18:
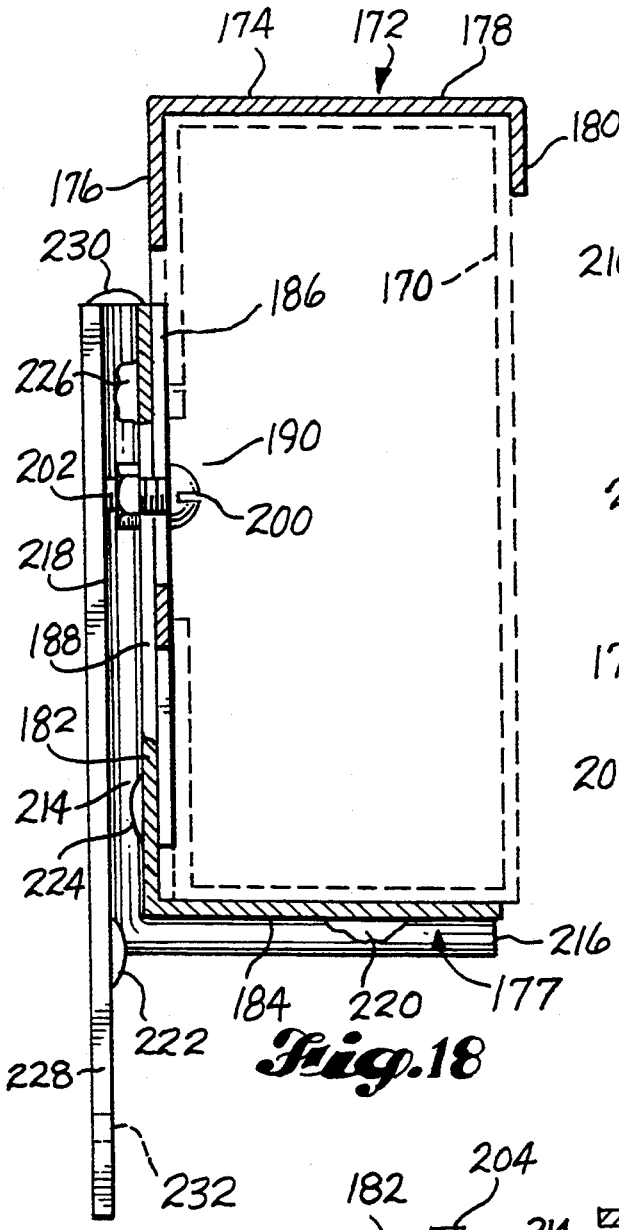
FIG. 18 is a vertical sectional view taken substantially along line 18—18 of FIG. 19, showing a mounting bracket that may be used for connecting the display holder to a horizontal beam, such view showing a beam in phantom lines.
Figure 19:
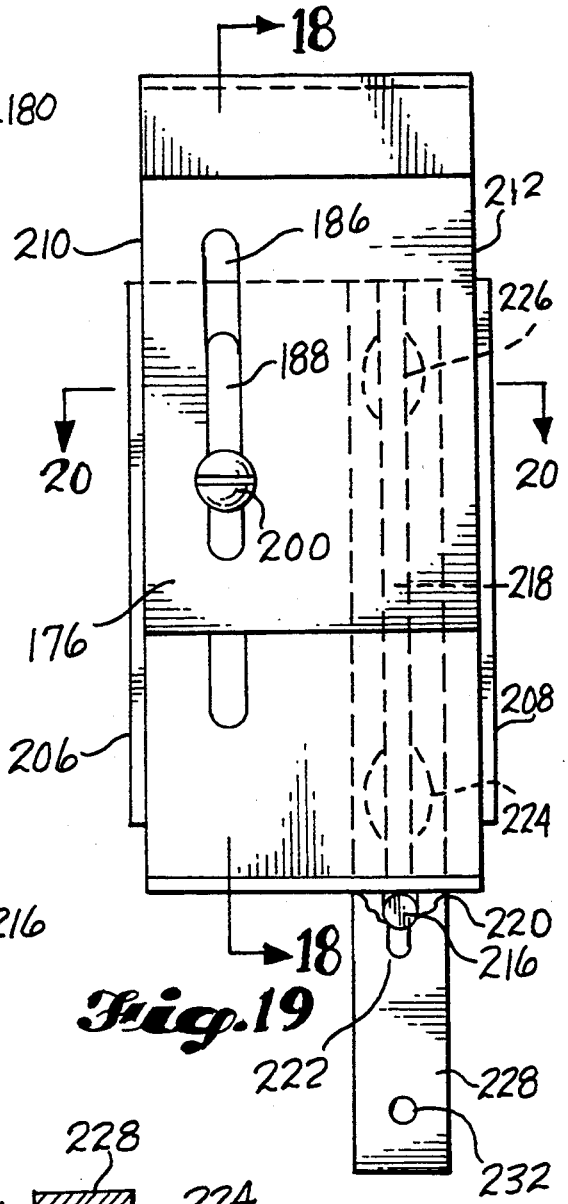
FIG. 19 is an elevational view looking towards the left side of FIG. 18.
Figure 20:
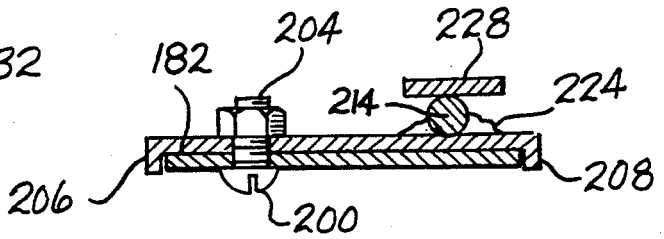
FIG. 20 is a sectional view taken substantially along line 20—20 of FIG. 19.

FIGS. 18–20 illustrate the mounting bracket that may be used for securing the first embodiment (FIGS. 1–13) to a horizontal frame member or beam 170. Beam 170 may be like frame member 160 shown in FIG. 15. The mounting bracket 172 would be used in place of the connector 108. Mounting bracket 172 comprises a first part 174 and a second part 177. Part 174 has a vertical wall 176, a top wall 178 and a flange 180. Flange 180 depends from top wall 178 and is parallel to wall 176. The second part 177 includes a vertical wall 182 and a bottom wall 184. Walls 182, 184 are perpendicular to each other. Walls 176, 178 are perpendicular to each other and flange 180 is perpendicular to wall 178. As illustrated, wall 176 side laps wall 182. Wall 176 includes a vertical slot 186 and wall 182 includes a vertical slot 188. Each slot 186,-188 is closed at both of its ends. Slots 186,188 are in alignment with each other, as best shown by FIG. 19. A screw fastener 190 extends through the two slots 186, 188. Screw fastener 190 includes a head 200 that is larger in diameter than the slots 186, 188 are wide. Screw 190 threads into a nut 202. The screw fastener 190 is screwed tight into the nut 202 so that it clamps the two members 176, 182 together. The provision of the slots 186, 188 and the screw fastener 190 permits adjustment of the mounting bracket 172 to different depth beams. Member 182 may include a pair of side flanges 206,208 between which the vertical leg of member 176 is received. Flanges 206, 208 contact the opposite edges 210,212 of vertical wall 176, to prevent bracket 172 from rotating in position relative to member 176, about the axis of the fastener screw 190. A spacer rod 214 is secured to the member 177. Rod 214 includes a horizontal leg 216 and a vertical leg 218. These legs 216, 218 are spot welded to member 177, at 220, 224 and 226. A flat bar 228 is welded to rod parts 216, 218 at 222 and 230. Flat bar 228 forms a flange that is sized and shaped to fit snugly within the lipped channel 104, in place of tongue 106. Bar 228 includes a threaded opening 232 which receives a set screw, like set screw 110. This set screw is used to firmly anchor the bar 228 in position relative to channel member 104 of mounting member 44.

Members 174, 177 are brought together about the beam 170. Then, the screw fastener 190 is tightened within nut 202, to firmly clamp members 174, 177 together. The square nature of the four corners of beam 170, the two corners of member 174 and the lower left (as pictured) corner of member 177 result in bracket 172 being firmly secured to the beam 170, and restrained against movement in essentially all directions. This clamping of the members 174, 177 together, and to the beam 170, provides a definite vertical placement of the member 228. Bar portion 218 provides a proper lateral spacing of flat bar 228 from vertical walls 176, 182. Member 218 is also sized to fit within the open region of the channel 104, between the two lips 100, 102.

The scope of protection is not to be limited by the illustrated examples. Rather, it is to be determined by a construction of the patent claims which follows, in accordance with established rules of patent claim construction, including use of the doctrine of equivalents.

What is claimed is:

1. A vertically elongated display holder, comprising:
a center panel having two side faces, two side edges, a top edge and a bottom edge;
a first frame portion at the first side edge;
a second frame portion at the second side edge;
a third frame portion at the top edge;
a fourth frame portion at the bottom edge;
said first and second frame portions integrally formed with the center panel to form a pair of vertically extending channels at the first and second side edges of the center panel, for receiving mounting portions of a display; and
at least one of said third and fourth frame portions being removable to permit insertion of a display into or removal of a display out from the channels.

2. A display holder according to claim 1, wherein the third and fourth frame portions are detachable from the center panel and include channels for snugly receiving end portions of the center panel.

3. A vertically elongated display holder, comprising:
a center panel having two side faces, two side edges, a top edge and a bottom edge;
a first frame portion at the first side edge;
a second frame portion at the second side edge;
a third frame portion at the top edge;
a fourth frame portion at the bottom edge;
said first and second frame portions forming with the center panel a pair of vertically extending channels at the first and second side edges of the center panel for receiving mounting portions of a display; and
at least one of said third and fourth frame portions being removable to permit insertion of a display into or removal of a display out from the channels,
wherein said first edge frame portion is formed integral with the center panel and comprises a base strip which extends perpendicular to the center panel, said base strip having opposite side edges, a first flange connected to the first side edge of said base strip, a second flange connected to the second side edge of the base strip, said flanges both extending from the base strip in a direction generally opposite the center panel, a first lip extending laterally inwardly from the first flange, a second lip extending laterally inwardly from the second flange, said lips being spaced from the base strip, and said base strip, said flanges and said lips together forming a channel space for receiving a flange portion of a mounting member.

4. A display holder according to claim 3, wherein said first frame portion includes a pair of frame flanges, on opposite sides of the panel, extending from the base strip in the same direction as the center panel, each said frame flange being spaced from the center panel so as to with the center panel form one of said vertically extending channels.

5. A display holder according to claim 4, wherein said second frame portion is also formed integral with the center panel and comprises a cap strip including a second pair of frame flanges, on opposite sides of the panel, extending in the same direction as the center panel, each of said second pair of frame flanges being spaced from the center panel so as to with the center panel form one of said vertically extending channels, with each vertically extending channel of the second edge frame portion confronting a vertically extending channel of the first frame portion.

6. A mountable display holder, comprising:

a plastic main member, formed by extrusion, and comprising a center panel having two side faces, first and second opposite edges, and third and fourth opposite edges, a first frame portion at the first edge, a second frame portion at the second edge, said first and second frame portions forming with the center panel a pair of confronting channels outwardly adjacent a said side face of the center panel, said channels being adapted for receiving mounting portions of a display;

a third frame portion at the third edge of the center panel, forming a first end closure for the channels, and a fourth frame portion at the fourth edge of the center panel, forming a second end closure for the channels, and with at least one of said third and fourth frame portions being removable from the center panel, to permit insertion and/or removal of a display into and/or out from the channels, wherein the first frame portion is connected to a mounting structure for the display holder, and wherein said first frame portion includes a lipped channel opening outwardly away from the center panel, and an elongated mounting member having a flange portion received within said lipped channel, wherein said mounting member includes a second flange portion spaced from the flange portion that is received within said lipped channel, and a web interconnecting said flange portions, said web having a normal position in which it extends substantially perpendicular to both flange portions, said web being bendable and resilient, so that when the second flange portion is anchored, the display holder will swing in position relative to the second flange portion, in response to a force applied against the display holder, perpendicular to the general plane of the web, and in response to such force the web will bend, and in response to a release of the force the web will resume its normal position.

7. A display holder according to claim 6, wherein the two flange portions of the mounting member are substantially rigid relative to the web.

8. A mountable display holder, comprising:

a plastic main member, formed by extrusion, and comprising a center panel having two side faces, first and second opposite edges and third and fourth opposite edges, a first frame portion at the first edge, a second frame portion at the second edge, said first and second frame portions forming with the center panel a pair of confronting channels outwardly adjacent a said side face of the center panel, said channels being adapted for receiving mounting portions of a display;

a third frame portion at the third edge of the center panel, forming a first end closure for the channels, and a fourth frame portion at the fourth edge of the center panel, forming a second end closure for the channels, and with at least one of said third and fourth frame portions being removable from the center panel, to permit insertion and/or removal of a display into and/or out from the channels, wherein the first frame portion is provided with a mounting structure comprising a bendable and resilient web that extends away from the first frame portion in a direction generally opposite from the center panel, and a relatively rigid mounting flange connected to said web, said mounting flange extending generally perpendicular to the center panel, said web functioning as a hinge, so that when the flange is anchored and in response to a force applied against the display holder, generally perpendicular to the general plane of the web, the web will bend, allowing the display holder to swing in position, and said web having sufficient resilience that in response to a release of the force the web will return the display panel to a set at rest position.

9. In combination, a horizontal beam that is substantially rectangular in cross section;

a mounting unit having an upper hook portion which engages an upper portion of the beam, and a lower portion which engages the beam from below, said mounting unit including a vertical flange;

a display holder; and structure connecting the display holder to the mounting unit, including a lipped channel in which the vertical flange of the mounting unit is snugly received, and a flexible hinge strip between said lipped channel and said display holder, said hinge strip being constructed from a flexible plastic material which will bend in response to a force applied against the display holder, allowing the display holder to swing in position, and will return the display holder to a normal at rest position when the force is removed from the display holder.

10. A display holder according to claim 9, wherein the mounting unit has upper and lower parts, each with a vertical wall, said vertical walls side lapping each other, said vertical walls including aligned slots, and a screw fastener extending through said slots and engaging a nut, said screw fasteners and nut serving to hold the two parts together, in a position in which they both engage the beam, said vertical flange being connected to one of said parts.

11. A mountable display holder, comprising:

a holding frame adapted to hold a display, said holding frame including a rigid, elongated edge portion;

a rigid, elongated mounting member extending parallel to the elongated edge portion of the holding frame; and a hinge in the form of an elongated web located between the rigid, elongated edge portion of said holding frame and said rigid, elongated mounting member, said elongated web having an "at rest" position in which it holds the holding frame in a set position relative to the rigid, elongated mounting member, said elongated web being laterally bendable and resilient, so that when mounted the rigid, elongated mounting member is fixed vertically lengthwise in position to a support, with the elongated web extending generally vertically, and in response to a force applied against the holding frame, said elongated web will bend and the holding frame will swing in position relative to the rigid, elongated mounting member, and in response to a release of the force, the web will resiliently resume its "at rest" position, causing the holding frame to be biased by the web to said set position.

12. A display holder according to claim 11, wherein said hinge comprises two rigid, laterally spaced, elongated flanges, and wherein said elongated web extends between and interconnects said rigid, elongated flanges.

13. A display holder according to claim 12, wherein the two rigid, elongated flanges and said elongated web are of one-piece integral construction.

14. A display holder according to claim 13, wherein the two rigid, elongated flanges and said elongated web are a single member formed by co-extrusion.

* * * * *

UNITED STATES PATENT AND TRADEMARK OFFICE

CERTIFICATE OF CORRECTION

PATENT NO. : 5,419,134

DATED : May 30, 1995

INVENTOR(S) : Scott S. Gibson

It is certified that error appears in the above-identified patent and that said Letters Patent is hereby corrected as shown below:

On the cover page, under [56] References Cited, mentions should be made of -- 3,740,881 6/1973 Finger --

Column 1, line 24, "Growei" should be -- Growe--.

Column 7, line 34, "-188" should be -- 188 --.

Claim 8, column 9, line 61, there is a comma after "edges".

Claim 10, column 10, line 49, "fasteners" should be -- fastener --.

Signed and Sealed this

Seventeenth Day of October, 1995

Bruce Lehman

*Attest:*

BRUCE LEHMAN

*Attesting Officer*

*Commissioner of Patents and Trademarks*